US010325605B2

(12) United States Patent
Park

(10) Patent No.: US 10,325,605 B2
(45) **Date of Patent: *Jun. 18, 2019**

(54) AUDIO DECODER STATE UPDATE FOR PACKET LOSS CONCEALMENT

(71) Applicant: INTEL IP CORPORATION, Santa Clara, CA (US)

(72) Inventor: Youngho Park, San Diego, CA (US)

(73) Assignee: INTEL IP CORPORATION, Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/037,845

(22) Filed: Jul. 17, 2018

(65) Prior Publication Data

US 2018/0350373 A1 Dec. 6, 2018

Related U.S. Application Data

(63) Continuation of application No. 15/613,487, filed on Jun. 5, 2017, now Pat. No. 10,037,761.

(51) Int. Cl.
*G10L 19/16* (2013.01)
*G10L 19/005* (2013.01)

(52) U.S. Cl.
CPC ..... *G10L 19/005* (2013.01); *G10L 19/167* (2013.01)

(58) Field of Classification Search
CPC ..... G10L 19/005; G10L 19/167
See application file for complete search history.

(56) References Cited

U.S. PATENT DOCUMENTS 10,037,761 B1 * 7/2018 Park ..... G10L 19/005
2006/0259849 A1 * 11/2006 Conway ..... H03M 13/37 714/776
2008/0046237 A1 * 2/2008 Zopf ..... G10L 19/005 704/228
2008/0046249 A1 * 2/2008 Thyssen ..... G10L 19/005 704/262
2010/0125454 A1 * 5/2010 Zopf ..... G10L 19/005 704/219

(Continued)

OTHER PUBLICATIONS

Sun, X., et al., "Decoder State-Copying for Bluetooth CVSD Packet Loss Concealment", Cambridge Silicon Radio, =First Received on May 16, 2017, 4 pages.

*Primary Examiner* — Samuel G Neway
(74) *Attorney, Agent, or Firm* — Finch & Maloney PLLC

(57) ABSTRACT

Techniques are provided for updating state data of an audio decoder for packet loss concealment (PLC). A methodology implementing the techniques according to an embodiment includes decoding encoded bits in a sequence of audio packets. A decoder history buffer stores the encoded bits and decimated state data associated with the decoding of those bits. The decimation factor of the state data is based on a down-sampling rate of the decoder. The method further includes performing PLC for an invalid audio packet using concealment samples from a PLC history buffer. The state of the audio decoder is updated from the decoder history buffer, based on timing associated with the concealment samples. The method further includes re-decoding the stored encoded bits associated with the updated state data, to further update the state of the audio decoder for subsequent decoding of a valid audio packet following the invalid audio packet.

20 Claims, 7 Drawing Sheets

(56) References Cited

U.S. PATENT DOCUMENTS

2010/0324911 A1* 12/2010 Jougit ..... G10L 19/005
704/500
2014/0119478 A1* 5/2014 Fazeldehkordi .... H04L 25/4927
375/341

* cited by examiner

AUDIO DECODER STATE UPDATE FOR PACKET LOSS CONCEALMENT

CROSS-REFERENCE TO RELATED APPLICATION

This application is a continuation application and claims the benefit of U.S. patent application Ser. No. 15/613,487, filed on Jun. 5, 2017, the entire content of which is herein incorporated by reference.

BACKGROUND

Wireless audio communication systems typically employ an encoding scheme which is applied to a stream of audio data, for example to achieve compression, and then packetize the encoded data for transmission over a radio channel. During transmission, however, some packets can be lost or corrupted due to interference, fading, and other such problems. These invalid packets result in missing audio samples which cause audio glitches at the receiving end and negatively impact the user's listening experience. Packet loss concealment techniques are often employed to reduce this audio degradation. Packet loss concealment generally operates to provide replacement audio samples that approximate the missing audio samples caused by the invalid packet.

Many audio encoders/decoders (codecs) maintain state data during the encoding/decoding process. Such state data includes information related to the processing of previous audio samples and is necessary to correctly process the current and future audio samples. Unfortunately, when a missing, corrupted, or otherwise invalid packet is encountered, the decoder state data is lost and an output error will be introduced and propagated into the processing of subsequent valid packets. This error will generally cause a noticeable discontinuity (e.g., glitch) or phase distortion in the audio output despite any attempts at packet loss concealment.

BRIEF DESCRIPTION OF THE DRAWINGS

Features and advantages of embodiments of the claimed subject matter will become apparent as the following Detailed Description proceeds, and upon reference to the Drawings, wherein like numerals depict like parts.

Figure 1:
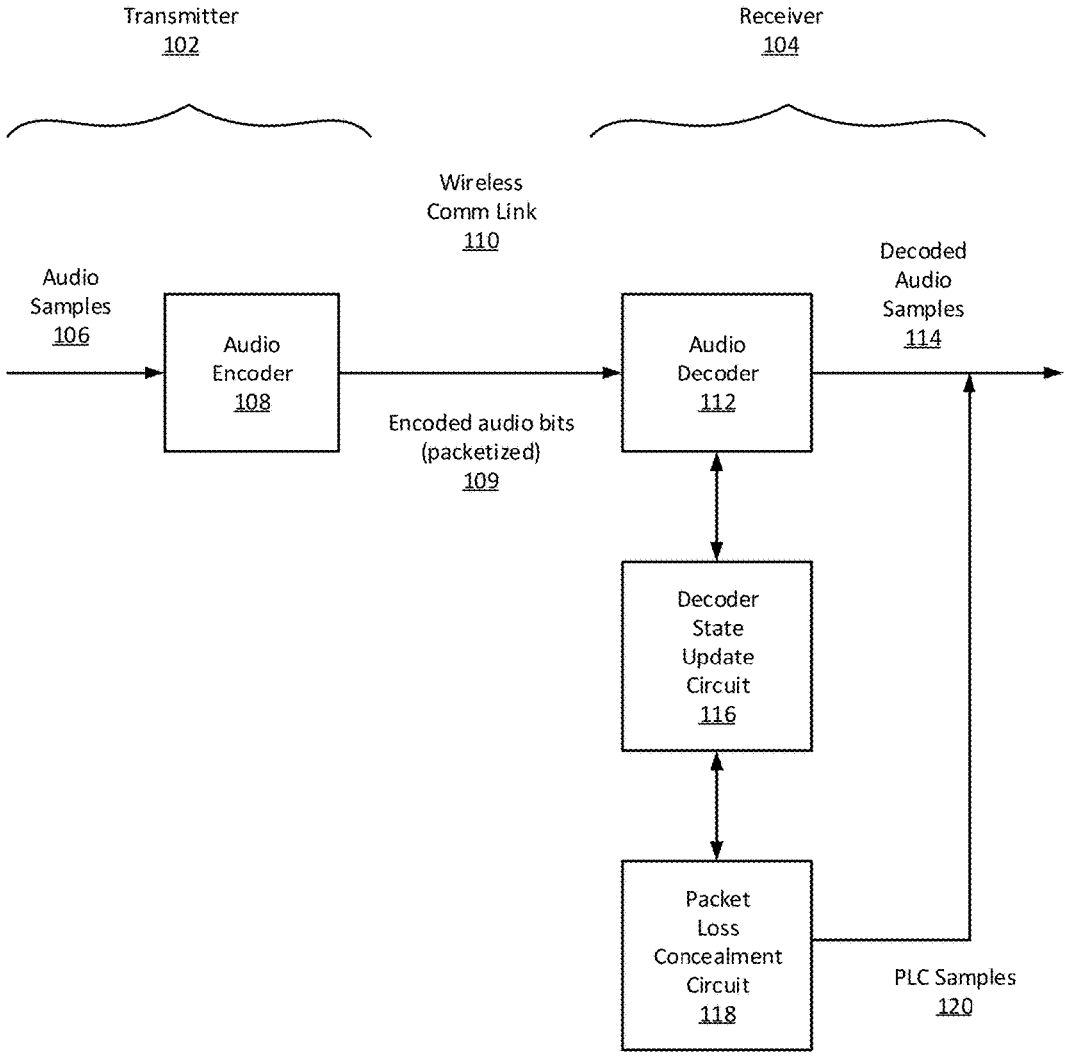
FIG. 1 is a top-level block diagram of an audio receiver configured with decoder state update for packet loss concealment, in accordance with certain embodiments of the present disclosure.

Although the following Detailed Description will proceed with reference being made to illustrative embodiments, many alternatives, modifications, and variations thereof will be apparent in light of this disclosure.

DETAILED DESCRIPTION

Generally, this disclosure provides techniques for updating the state data of an audio decoder for improved packet loss concealment (PLC) when transmitted packets are lost or corrupted. Such lost or corrupted packets are generally referred to herein as invalid packets. PLC techniques are employed to search through a history buffer containing previously decoded audio samples, to find a segment of audio that is suitable for use as a replacement/substitution for the missing audio that would otherwise result from the invalid packet. Decoder state update techniques are employed to search through a decoder history buffer to find a previously stored decoder state (and associated encoded bits) from a time just prior to the previously decoded audio samples found by the PLC for use as replacement samples. The decoder state is then updated to the previously stored decoder state. The decoder is then applied to the previously stored associated encoded bits to re-decode those bits and, in the process, further update the decoder state to a state that approximates the state that the decoder would have reached after decoding the bits that were lost from the invalid packet. Thus, packet loss concealment is enhanced with proper decoder state data.

The disclosed techniques can be implemented, for example, in a computing system or a software product executable or otherwise controllable by such systems, although other embodiments will be apparent. The system or product is configured to update the state data of an audio decoder in conjunction with the performance of packet loss concealment to correct for an invalid received audio packet. In accordance with an embodiment, a methodology to implement these techniques includes decoding the encoded bits in a sequence of audio packets. A decoder history buffer is provided to store the encoded bits along with the state data associated with the decoding of those bits. The state data is stored in a decimated fashion wherein the decimation factor is based on a down-sampling output rate of the decoder. The method further includes performing PLC for an invalid audio packet in the sequence of encoded audio packets, using concealment samples selected from a group of previous output audio samples stored in a PLC history buffer. The state of the audio decoder is updated based on state data retrieved from the decoder history buffer. The retrieval of the state data is based on the timing associated with the selected concealment samples, as will be described in greater detail below. The method further includes re-decoding the stored encoded bits associated with the retrieved state data, to further update the state of the audio decoder for subsequent decoding of a valid audio packet following the invalid audio packet.

As will be appreciated, the techniques described herein may allow for improved audio decoding recovery after loss of an encoded packet, compared to existing methods that fail to correct for a discontinuity in the decoder state resulting from a lost packet, which can propagate decoding errors forward in time through subsequent valid packets. The disclosed techniques can be implemented on a broad range of platforms including laptops, tablets, smart phones, workstations, and embedded systems or devices. These techniques may further be implemented in hardware or software or a combination thereof.

FIG. 1 is a top-level block diagram 100 of an implementation of an audio transmitter and audio receiver with decoder state update for packet loss concealment, configured in accordance with certain embodiments of the present disclosure.

The transmitter 102 is shown to include an audio encoder 108 configured to code audio samples 106 into encoded bits, for example to achieve compression, and packetize them for transmission. The resulting encoded and packetized audio bits 109 are then transmitted over a wireless communications link 110 to a receiver 104 for decoding and subsequent use. Unfortunately, some packets may be lost or corrupted during transmission resulting in degraded audio for the user at the receiver side. Packet loss concealment along with decoder state update techniques, as described below, may be employed to at least partially correct for this condition.

The combination of audio encoder and decoder is sometimes referred to as a codec. Many codecs, such as for example, the continuously variable slope delta modulation (CVSD) codec employed in Bluetooth wireless communications are state-based. That is to say, the encoding and decoding of each encoded audio bit depends on the values of the previous bits. Information about the encoding and decoding of the previous bits is stored in state data that is maintained on both the encoding and decoding side of the communications link. State data may include, for example, one or more of a coding step size, a previous output audio sample, a finite impulse response (FIR) filter memory, a sign bit, and any other suitable information used by the particular codec. If the state data maintained at the decoder becomes unsynchronized with the state data being employed at the encoder, for example due to an invalid packet, errors will occur in the decoding process.

The receiver 104 is shown to include an audio decoder 112, a decoder state update circuit 116, and a packet loss concealment circuit 118. The audio decoder 112 is configured to decode the received encoded audio bits 109 to generate decoded audio samples 114. The packet loss concealment circuit 118 is configured to provide replacement PLC audio samples 120 to conceal the losses resulting from invalid packets. The decoder state update circuit 116 is configured to update the state of the decoder 112 when an invalid packet is encountered, as will be described in greater detail below.

Figure 2:
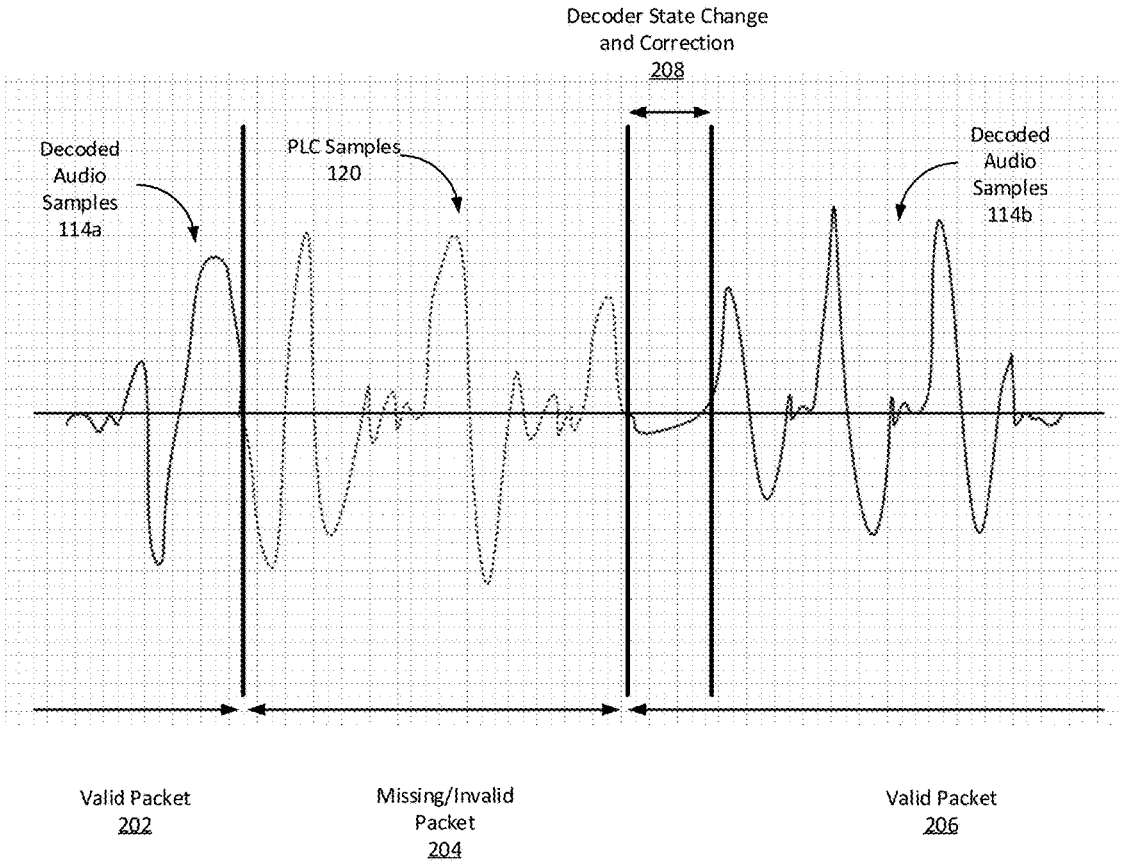
FIG. 2 is a plot of the decoder output associated with an invalid packet and a state update, in accordance with certain embodiments of the present disclosure.

FIG. 2 is a plot 200 of the decoder output associated with an invalid packet and a state update, in accordance with certain embodiments of the present disclosure. Decoded audio samples 114 are shown for a valid received packet 202. When a missing or invalid packet 204 is encountered in the stream of encoded audio packets 109, PLC samples 120 are generated and substituted into the output to conceal the corrupted audio that would otherwise result from the missing packet. The state of the decoder is updated to an estimated correct state during the missing packet interval using the disclosed techniques described below. A new valid packet 206 is shown to be received after the invalid packet 204, and the decoder resumes generating decoded audio samples 114*b* based on the valid packet 206 and the updated state data. A time period 208 is also shown during which the decoder state continues to change/adapt from the estimated correct state to a true correct state, based on the processing of the valid packet 206.

Figure 3:
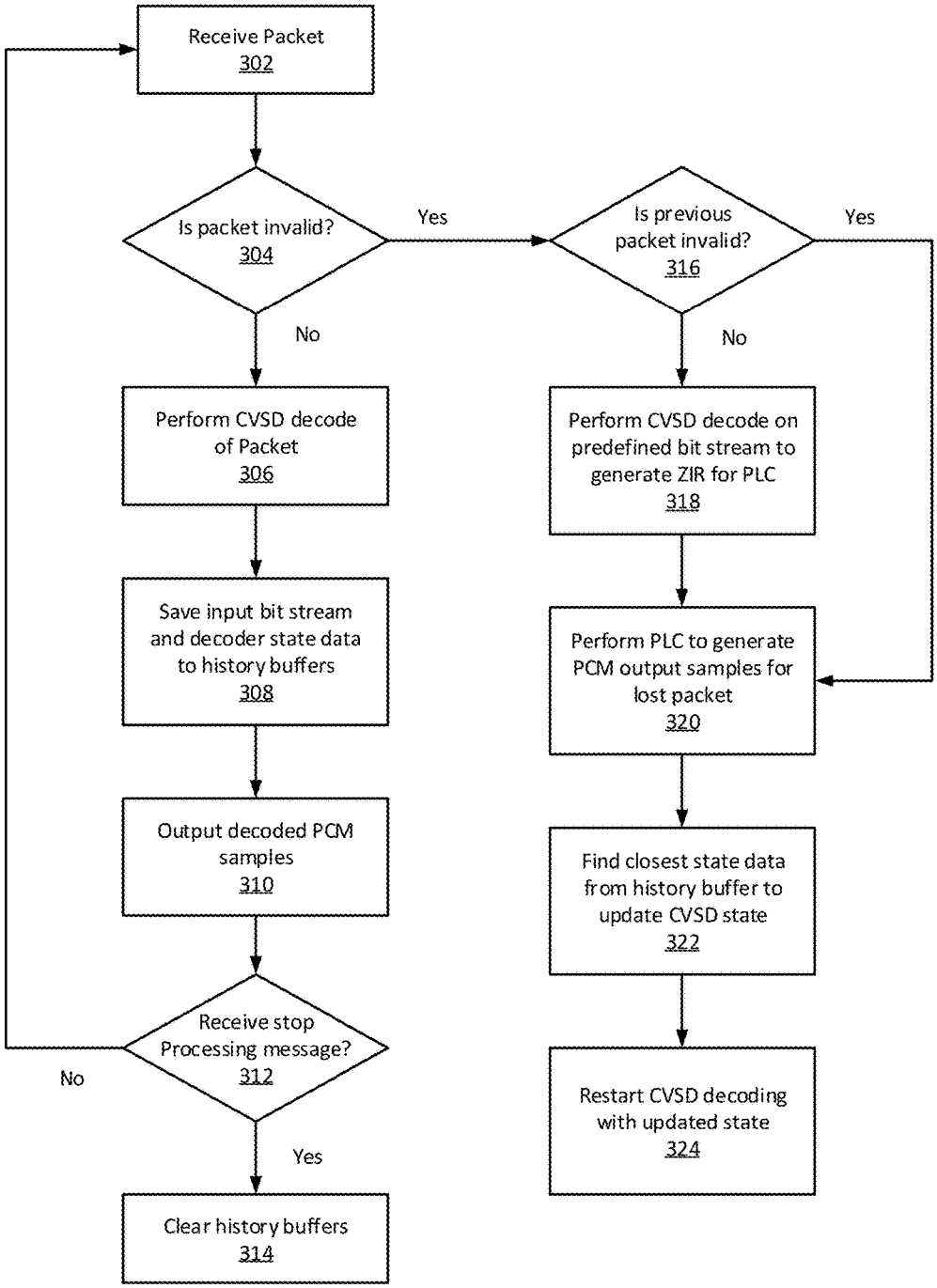
FIG. 3 is a flowchart illustrating a methodology for updating the decoder state, in accordance with certain embodiments of the present disclosure.

FIG. 3 is a flowchart illustrating a methodology 300 for decoding audio packets using a state-based audio decoder (such as a CVSD decoder), and for updating the state of the decoder in response to receiving an invalid packet, in accordance with certain embodiments of the present disclosure. The operation of the decoder and the state update process is described here at a relatively high level. Additional detail will be provided below in connection with the description of FIG. 4.

At operation 302, an encoded audio packet is received. At operation 304, it is determined whether the packet is valid or invalid (e.g., missing). If the packet is valid, then at operation 306, the audio decoder performs CVSD decoding of the packet. At operation 308, the input encoded bitstream is saved, along with the decoder state data, to a decoder history buffer. At operation 310, the decoded audio samples are provided as output, for example in a pulse code modulation (PCM) format. At operation 312, if a "stop processing" message or control signal has not been received, the decoding continues with a new received packet, at operation 302. Otherwise, the decoding process stops and the history buffers are cleared at operation 314.

If an invalid packet is received however, then at operation 316, it is determined whether the previous packet was also invalid, in which case the process continues at operation 320 below. Otherwise, if this is the first invalid packet, then at operation 318, a CVSD decode is performed on a predefined bitstream that is configured to generate a zero-input response (ZIR) to be used by the packet loss concealment algorithm, using known techniques in light of the present disclosure. At operation 320, packet loss concealment is performed to generate PCM output audio samples for the lost packet. At operation 322, the decoder history buffer is searched to find suitable state data for updating of the CVSD state, as will be described in greater detail below. At operation 324 the CVSD decoding is restarted for the next valid packet using the updated state.

Figure 4:
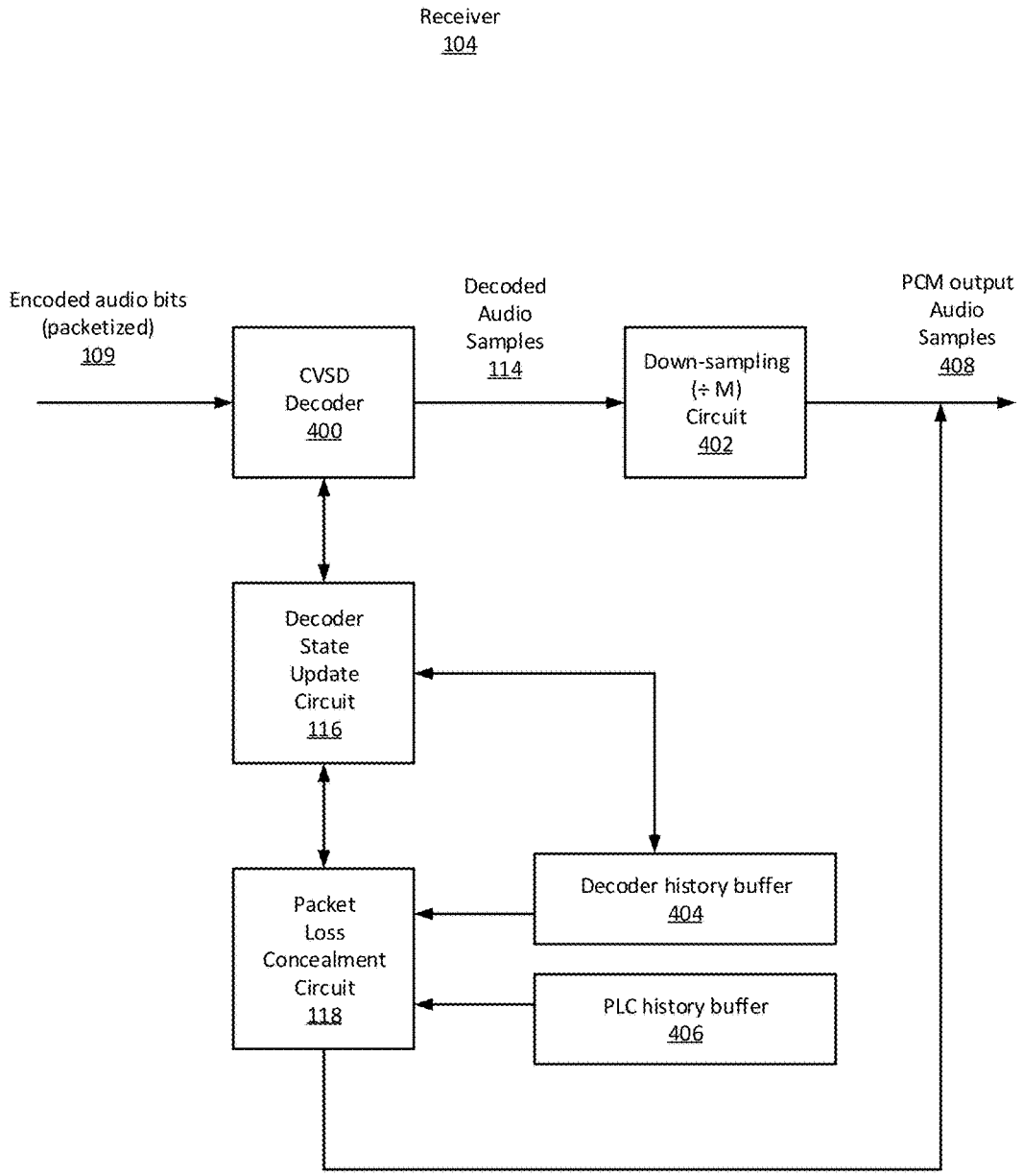
FIG. 4 is a more detailed block diagram of the audio receiver configured with decoder state update, in accordance with certain embodiments of the present disclosure.

FIG. 4 is a more detailed block diagram of the audio receiver with decoder state update 104, configured in accordance with certain embodiments of the present disclosure. The receiver 104 is shown to include a continuously variable slope delta modulation (CVSD) audio decoder 400, the decoder state update circuit 116, the packet loss concealment circuit 118, a down-sampling circuit 402, a decoder history buffer 404, and a PLC history buffer 406.

The CVSD audio decoder 400 is configured to accept encoded audio bits 109, that were previously encoded using continuously variable slope delta modulation encoding and transmitted in a sequence of audio packets. The CVSD audio decoder 400 is a state-based decoder that generates decoded audio samples 114, using known decoding techniques, in light of the present disclosure. The down-sampling circuit 402 is configured to down-sample the decoded audio samples 114 by a factor of M to generate output audio samples 408. In some embodiments, the output audio samples may be provided in a pulse code modulation (PCM) format and may be played to the user or stored for future use. In some embodiments, for example when the encoded audio bits 109 are transmitted over a Bluetooth link, the decimation factor M is set to 8.

The decoder history buffer 404 is configured to store the encoded bits 109 and to store the state data associated with the decoding of those encoded bits. The state data is decimated (e.g., to conserve memory) by a decimation factor associated with the down-sampling output rate of the audio decoder. For example, in some embodiments, the down sampling rate M is 8 and the decimation factor may be set to 16 (e.g., 2 times M). Thus, in this case the decoder state would be saved for every 16th encoded bit.

The packet loss concealment (PLC) circuit 118 is configured to perform packet loss concealment of an invalid audio packet that is encountered in the received sequence of encoded audio packets. The PLC circuit 118 generates concealment samples to fill the gap in the output that would otherwise result from the invalid packet.

The concealment samples are obtained from a group of previously generated output audio samples which are stored in a PLC history buffer 406. The PLC circuit 118 is configured to search through the PLC history buffer for a segment of audio that most closely matches the output audio samples that were generated from the valid packet that immediately precedes the invalid packet. The matching may be based on a suitable metric of similarity such as, for example, a comparison of measured pitch periods. The concealment samples are then selected from the subsequent saved audio samples in the PLC history buffer which follow the matching samples that were found through the search.

The decoder state update circuit 116 is configured to update the state of the audio decoder based on state data retrieved from the decoder history buffer. The state data is retrieved from a point in time that is equal to or earlier than the time associated with the concealment samples that were retrieved from the PLC history buffer. The audio decoder then re-decodes the stored encoded bits in the decoder history buffer, from the point in time associated with the retrieved state data that was used to update the decoder, through to the last encoded bit that is associated with the concealment samples. The state of the audio decoder continues to update during the re-decoding process such that the final decoder state matches the state that the decoder would have reached after generating the concealment samples, which approximates the state that the decoder would have reached after decoding the bits that were lost from the invalid packet. The re-decoded samples that result from the re-decoding process may be discarded since the objective of the re-decoding is to update the state of the decoder to the point where the decoder may proceed to decode the valid audio packet that follows the invalid audio packet.

Figure 5:
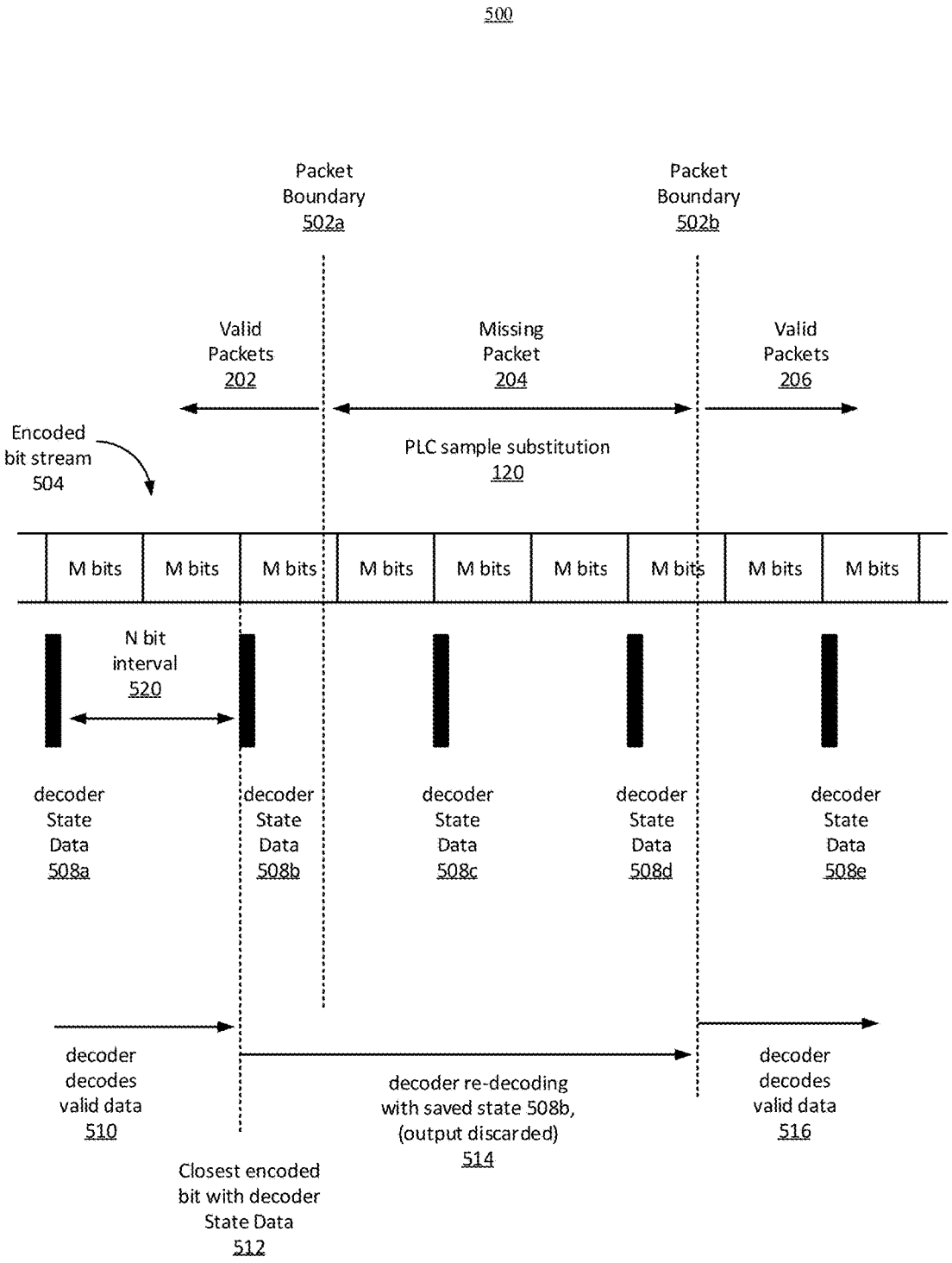
FIG. 5 illustrates a timeline of the decoder state update, in accordance with certain embodiments of the present disclosure.

FIG. 5 illustrates a timeline 500 of the decoder state update, in accordance with certain embodiments of the present disclosure. Packet boundary 502*a* is shown to separate earlier valid packets 202 from an invalid packet 204. Similarly, packet boundary 502*b* is shown to separate the invalid packet 204 from subsequent valid packets 206. As previously described, PLC replacement samples 120 will be substituted into the output audio 408 associated with the invalid packet 204.

An encoded bitstream 504 is shown to be composed of groups of M bits that are received for decoding. M is the output down-sampling factor used by circuit 402. For example, if M=8, every eight encoded bits 504 will result in one output audio sample 408. Decoder state data 508(*a* . . . *e*) is stored in the decoder history buffer 404 at a decimated rate corresponding to an N bit interval 520. In some embodiments, the N bit interval may be chosen to correspond to two groups of M bits.

In this illustrative example, the decoder decodes valid data 510 and stores decimated decoder state data 508(*a* . . . *e*) and encoded bitstream 504 in the decoder history buffer 404 during the decoding process. In response to the invalid packet 204 and PLC sample substitution 120, the decoder state update circuit 116 finds the stored encoded bit 512 (and decoder state data 508*b*) closest in time to (coincident with or earlier than) the start of the PLC samples retrieved from the PLC history buffer. The decoder then re-decodes the stored encoded bits 514 starting at 512, further updating the state during the process and discarding the re-decoded output, until it reaches the end of the packet concealment. The decoder then has a corrected state to continue decoding valid data 516 from subsequent valid packets 206.

Methodology

Figure 6:
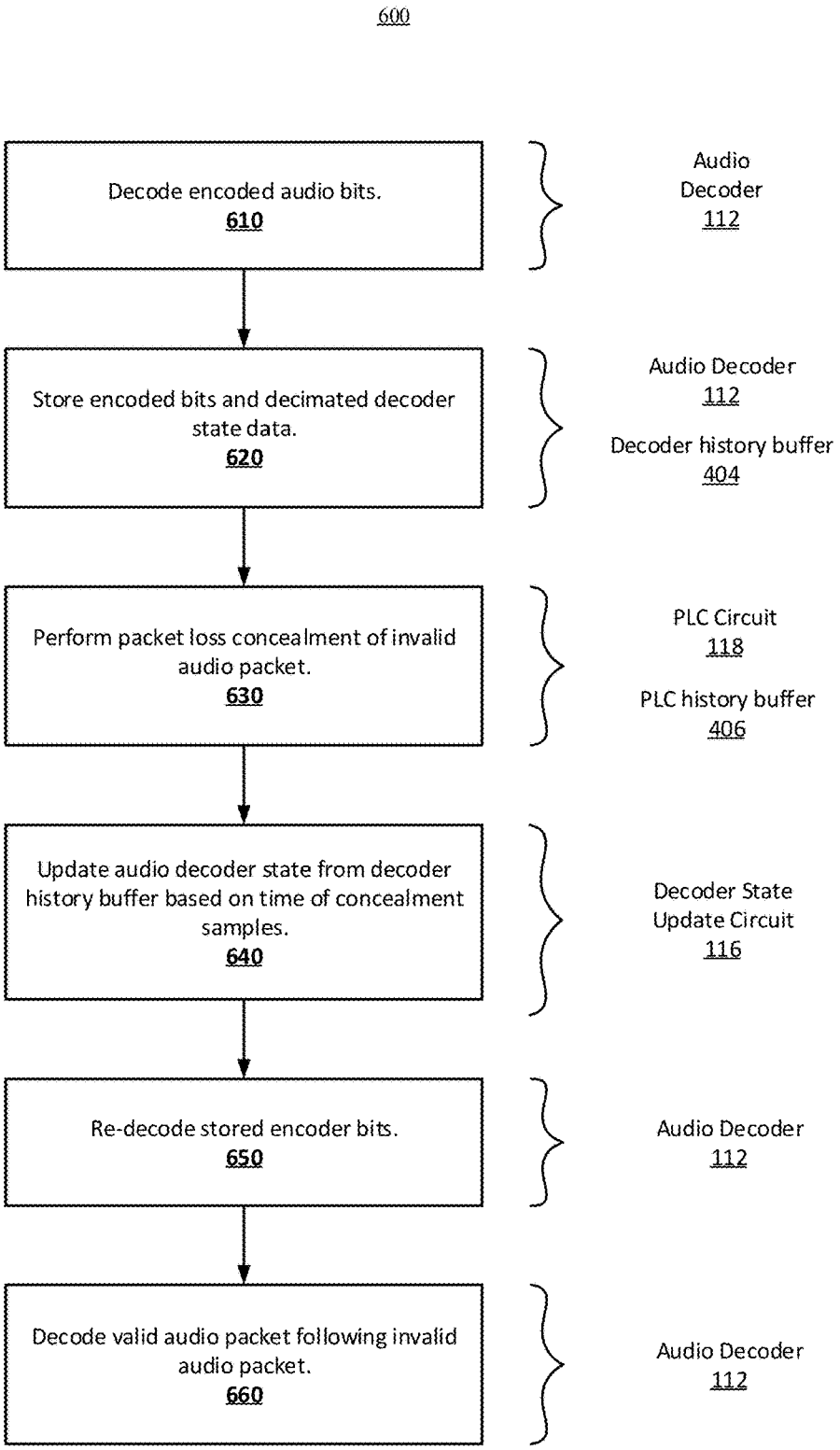
FIG. 6 is another flowchart illustrating a methodology for updating the decoder state, in accordance with certain embodiments of the present disclosure.

FIG. 6 is a flowchart illustrating an example method 600 for updating the state data of an audio decoder for improved packet loss concealment (PLC), in accordance with certain embodiments of the present disclosure. As can be seen, the example method includes a number of phases and sub-processes, the sequence of which may vary from one embodiment to another. However, when considered in the aggregate, these phases and sub-processes form a process for decoder state update in accordance with certain of the embodiments disclosed herein. These embodiments can be implemented, for example using the system architecture illustrated in FIGS. 1 and 4 as described above. However other system architectures can be used in other embodiments, as will be apparent in light of this disclosure. To this end, the correlation of the various functions shown in FIG. 6 to the specific components illustrated in the other figures is not intended to imply any structural and/or use limitations. Rather, other embodiments may include, for example, varying degrees of integration wherein multiple functionalities are effectively performed by one system. For example, in an alternative embodiment a single module having decoupled sub-modules can be used to perform all of the functions of method 600. Thus, other embodiments may have fewer or more modules and/or sub-modules depending on the granularity of implementation. In still other embodiments, the methodology depicted can be implemented as a computer program product including one or more non-transitory machine readable mediums that when executed by one or more processors cause the methodology to be carried out. Numerous variations and alternative configurations will be apparent in light of this disclosure.

As illustrated in FIG. 6, in an embodiment, method 600 for updating the state data of an audio decoder commences at operation 610 by decoding encoded bits that are included in a sequence of encoded audio packets to generate output audio samples. In some embodiments, the output audio samples are down-sampled to a lower sample rate.

Next, at operation 620, the encoded bits are stored, along with the associated decoder state data, in a decoder history buffer. The state data is stored in a decimated form, for example to conserve memory. In some embodiments, the decimation rate may be based on the down-sampling output rate of the decoder.

At operation 630, packet loss concealment is performed to correct for the reception of an invalid audio packet in the sequence of encoded audio packets that may result from a transmission error. The PLC substitutes concealment samples into the decoded output audio stream. The concealment samples are selected from a group of previous output audio samples that were stored in a PLC history buffer. A search is performed for previous output audio samples that satisfy a measure of similarity to the output audio samples associated with the valid audio packet that immediately preceded the invalid audio packet. The samples that follow the samples resulting from the search are then used as the concealment samples.

At operation 640, the state of the audio decoder is updated based on state data retrieved from the decoder history buffer. The retrieved state data is associated with a time period equal to or earlier than the time period associated with the start of the stored concealment samples from the PLC history buffer.

At operation 650, the stored encoded bits associated with the retrieved state data are re-decoded, and the state of the audio decoder continues to be updated during the re-decoding process. The output samples generated by the re-decoding may be discarded since the purpose of the re-decoding is to update the decoder state. The re-decoding of the stored encoded bits is performed up to a time associated with the end of the sequence of samples used for concealment.

At operation 660, a valid audio packet that follows the invalid audio packet is then decoded using the resulting updated audio decoder state.

Of course, in some embodiments, additional operations may be performed, as previously described in connection with the system. For example, the sequence of encoded audio packets may be received by the audio decoder over a wireless communications link. In some embodiments, the wireless communications link conforms to a Bluetooth communications protocol and the audio decoder is a continuously variable slope delta modulation (CVSD) decoder.

Example System

Figure 7:
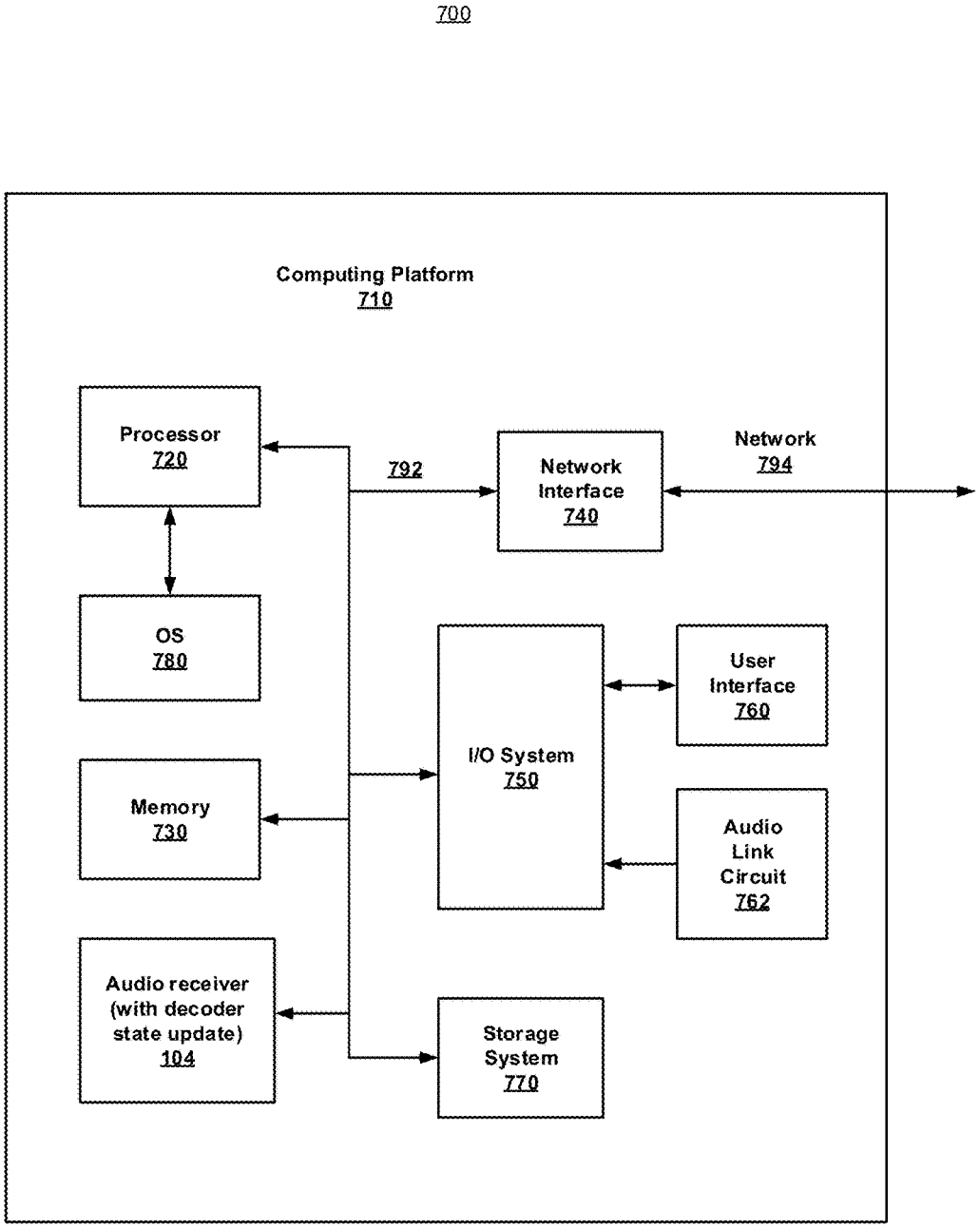
FIG. 7 is a block diagram schematically illustrating a computing platform configured to perform audio decoding with state data updates for packet loss concealment, in accordance with certain embodiments of the present disclosure.

FIG. 7 illustrates an example system 700 to perform audio decoding with updated state data for improved packet loss concealment (PLC), configured in accordance with certain embodiments of the present disclosure. In some embodiments, system 700 comprises a computing platform 710 which may host, or otherwise be incorporated into a personal computer, workstation, server system, laptop computer, ultra-laptop computer, tablet, touchpad, portable computer, handheld computer, palmtop computer, personal digital assistant (PDA), cellular telephone, combination cellular telephone and PDA, smart device (for example, smartphone or smart tablet), mobile internet device (MID), messaging device, data communication device, and so forth. Any combination of different devices may be used in certain embodiments.

In some embodiments, platform 710 may comprise any combination of a processor 720, a memory 730, an audio receiver with decoder state update 104, a network interface 740, an input/output (I/O) system 750, a user interface 760, an audio link circuit 762, and a storage system 770. As can be further seen, a bus and/or interconnect 792 is also provided to allow for communication between the various components listed above and/or other components not shown. Platform 710 can be coupled to a network 794 through network interface 740 to allow for communications with other computing devices, platforms, or resources. Other componentry and functionality not reflected in the block diagram of FIG. 7 will be apparent in light of this disclosure, and it will be appreciated that other embodiments are not limited to any particular hardware configuration.

Processor 720 can be any suitable processor, and may include one or more coprocessors or controllers, such as an audio processor, a graphics processing unit, or hardware accelerator, to assist in control and processing operations associated with system 700. In some embodiments, the processor 720 may be implemented as any number of processor cores. The processor (or processor cores) may be any type of processor, such as, for example, a microprocessor, an embedded processor, a digital signal processor (DSP), a graphics processor (GPU), a network processor, a field programmable gate array or other device configured to execute code. The processors may be multithreaded cores in that they may include more than one hardware thread context (or "logical processor") per core. Processor 720 may be implemented as a complex instruction set computer (CISC) or a reduced instruction set computer (RISC) processor. In some embodiments, processor 720 may be configured as an x86 instruction set compatible processor.

Memory 730 can be implemented using any suitable type of digital storage including, for example, flash memory and/or random access memory (RAM). In some embodiments, the memory 730 may include various layers of memory hierarchy and/or memory caches as are known to those of skill in the art. Memory 730 may be implemented as a volatile memory device such as, but not limited to, a RAM, dynamic RAM (DRAM), or static RAM (SRAM) device. Storage system 770 may be implemented as a non-volatile storage device such as, but not limited to, one or more of a hard disk drive (HDD), a solid-state drive (SSD), a universal serial bus (USB) drive, an optical disk drive, tape drive, an internal storage device, an attached storage device, flash memory, battery backed-up synchronous DRAM (SDRAM), and/or a network accessible storage device. In some embodiments, storage 770 may comprise technology to increase the storage performance enhanced protection for valuable digital media when multiple hard drives are included.

Processor 720 may be configured to execute an Operating System (OS) 780 which may comprise any suitable operating system, such as Google Android (Google Inc., Mountain View, Calif.), Microsoft Windows (Microsoft Corp., Redmond, Wash.), Apple OS X (Apple Inc., Cupertino, Calif.), Linux, or a real-time operating system (RTOS). As will be appreciated in light of this disclosure, the techniques provided herein can be implemented without regard to the particular operating system provided in conjunction with system 700, and therefore may also be implemented using any suitable existing or subsequently-developed platform.

Network interface circuit 740 can be any appropriate network chip or chipset which allows for wired and/or wireless connection between other components of computer system 700 and/or network 794, thereby enabling system 700 to communicate with other local and/or remote computing systems, servers, cloud-based servers, and/or other resources. Wired communication may conform to existing (or yet to be developed) standards, such as, for example, Ethernet. Wireless communication may conform to existing (or yet to be developed) standards, such as, for example, cellular communications including LTE (Long Term Evolution), Wireless Fidelity (Wi-Fi), Bluetooth, and/or Near Field Communication (NFC). Exemplary wireless networks include, but are not limited to, wireless local area networks, wireless personal area networks, wireless metropolitan area networks, cellular networks, and satellite networks.

I/O system 750 may be configured to interface between various I/O devices and other components of computer system 700. I/O devices may include, but not be limited to, user interface 760 and audio link circuit 762 (e.g., a Bluetooth transceiver). User interface 760 may include devices (not shown) such as a display element, touchpad, keyboard, mouse, and speaker, etc. I/O system 750 may include a graphics subsystem configured to perform processing of images for rendering on a display element. Graphics subsystem may be a graphics processing unit or a visual processing unit (VPU), for example. An analog or digital interface may be used to communicatively couple graphics subsystem and the display element. For example, the interface may be any of a high definition multimedia interface (HDMI), DisplayPort, wireless HDMI, and/or any other suitable interface using wireless high definition compliant techniques. In some embodiments, the graphics subsystem could be integrated into processor 720 or any chipset of platform 710.

It will be appreciated that in some embodiments, the various components of the system 700 may be combined or integrated in a system-on-a-chip (SoC) architecture. In some embodiments, the components may be hardware components, firmware components, software components or any suitable combination of hardware, firmware or software.

The audio receiver 104 is configured to decode received encoded audio packets and to perform packet loss concealment to correct for invalid packets, using decoder state update techniques to reduce audio glitches associated with the concealment, as described previously. The audio receiver 104 may include any or all of the circuits/components illustrated in FIGS. 1 and 4, as described above. These components can be implemented or otherwise used in conjunction with a variety of suitable software and/or hardware that is coupled to or that otherwise forms a part of platform 710. These components can additionally or alternatively be implemented or otherwise used in conjunction with user I/O devices that are capable of providing information to, and receiving information and commands from, a user.

In some embodiments, these circuits may be installed local to system 700, as shown in the example embodiment of FIG. 7. Alternatively, system 700 can be implemented in a client-server arrangement wherein at least some functionality associated with these circuits is provided to system 700 using an applet, such as a JavaScript applet, or other downloadable module or set of sub-modules. Such remotely accessible modules or sub-modules can be provisioned in real-time, in response to a request from a client computing system for access to a given server having resources that are of interest to the user of the client computing system. In such embodiments, the server can be local to network 794 or remotely coupled to network 794 by one or more other networks and/or communication channels. In some cases, access to resources on a given network or computing system may require credentials such as usernames, passwords, and/or compliance with any other suitable security mechanism.

In various embodiments, system 700 may be implemented as a wireless system, a wired system, or a combination of both. When implemented as a wireless system, system 700 may include components and interfaces suitable for communicating over a wireless shared media, such as one or more antennae, transmitters, receivers, transceivers, amplifiers, filters, control logic, and so forth. An example of wireless shared media may include portions of a wireless spectrum, such as the radio frequency spectrum and so forth. When implemented as a wired system, system 700 may include components and interfaces suitable for communicating over wired communications media, such as input/output adapters, physical connectors to connect the input/output adaptor with a corresponding wired communications medium, a network interface card (NIC), disc controller, video controller, audio controller, and so forth. Examples of wired communications media may include a wire, cable metal leads, printed circuit board (PCB), backplane, switch fabric, semiconductor material, twisted pair wire, coaxial cable, fiber optics, and so forth.

Various embodiments may be implemented using hardware elements, software elements, or a combination of both. Examples of hardware elements may include processors, microprocessors, circuits, circuit elements (for example, transistors, resistors, capacitors, inductors, and so forth), integrated circuits, ASICs, programmable logic devices, digital signal processors, FPGAs, logic gates, registers, semiconductor devices, chips, microchips, chipsets, and so forth. Examples of software may include software components, programs, applications, computer programs, application programs, system programs, machine programs, operating system software, middleware, firmware, software modules, routines, subroutines, functions, methods, procedures, software interfaces, application program interfaces, instruction sets, computing code, computer code, code segments, computer code segments, words, values, symbols, or any combination thereof. Determining whether an embodiment is implemented using hardware elements and/or software elements may vary in accordance with any number of factors, such as desired computational rate, power level, heat tolerances, processing cycle budget, input data rates, output data rates, memory resources, data bus speeds, and other design or performance constraints.

Some embodiments may be described using the expression "coupled" and "connected" along with their derivatives. These terms are not intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still cooperate or interact with each other.

The various embodiments disclosed herein can be implemented in various forms of hardware, software, firmware, and/or special purpose processors. For example, in one embodiment at least one non-transitory computer readable storage medium has instructions encoded thereon that, when executed by one or more processors, cause one or more of the methodologies disclosed herein to be implemented. The instructions can be encoded using a suitable programming language, such as C, C++, object oriented C, Java, JavaScript, Visual Basic .NET, Beginner's All-Purpose Symbolic Instruction Code (BASIC), or alternatively, using custom or proprietary instruction sets. The instructions can be provided in the form of one or more computer software applications and/or applets that are tangibly embodied on a memory device, and that can be executed by a computer having any suitable architecture. In one embodiment, the system can be hosted on a given website and implemented, for example, using JavaScript or another suitable browser-based technology. For instance, in certain embodiments, the system may leverage processing resources provided by a remote computer system accessible via network 794. In other embodiments, the functionalities disclosed herein can be incorporated into other software applications, including applications that employ wireless communications. The computer software applications disclosed herein may include any number of different modules, sub-modules, or other components of distinct functionality, and can provide information to, or receive information from, still other components. These modules can be used, for example, to communicate with input and/or output devices such as a display screen, a touch sensitive surface, a printer, and/or any other suitable device. Other componentry and functionality not reflected in the illustrations will be apparent in light of this disclosure, and it will be appreciated that other embodiments are not limited to any particular hardware or software configuration. Thus, in other embodiments system 700 may comprise additional, fewer, or alternative subcomponents as compared to those included in the example embodiment of FIG. 7.

The aforementioned non-transitory computer readable medium may be any suitable medium for storing digital information, such as a hard drive, a server, a flash memory, and/or random access memory (RAM), or a combination of memories. In alternative embodiments, the components and/or modules disclosed herein can be implemented with hardware, including gate level logic such as a field-programmable gate array (FPGA), or alternatively, a purpose-built semiconductor such as an application-specific integrated circuit (ASIC). Still other embodiments may be implemented with a microcontroller having a number of input/output ports for receiving and outputting data, and a number of embedded routines for carrying out the various functionalities disclosed herein. It will be apparent that any suitable combination of hardware, software, and firmware can be used, and that other embodiments are not limited to any particular system architecture.

Some embodiments may be implemented, for example, using a machine readable medium or article which may store an instruction or a set of instructions that, if executed by a machine, may cause the machine to perform a method and/or operations in accordance with the embodiments. Such a machine may include, for example, any suitable processing platform, computing platform, computing device, processing device, computing system, processing system, computer, process, or the like, and may be implemented using any suitable combination of hardware and/or software. The machine readable medium or article may include, for example, any suitable type of memory unit, memory device, memory article, memory medium, storage device, storage article, storage medium, and/or storage unit, such as memory, removable or non-removable media, erasable or non-erasable media, writeable or rewriteable media, digital or analog media, hard disk, floppy disk, compact disk read only memory (CD-ROM), compact disk recordable (CD-R) memory, compact disk rewriteable (CR-RW) memory, optical disk, magnetic media, magneto-optical media, removable memory cards or disks, various types of digital versatile disk (DVD), a tape, a cassette, or the like. The instructions may include any suitable type of code, such as source code, compiled code, interpreted code, executable code, static code, dynamic code, encrypted code, and the like, implemented using any suitable high level, low level, object oriented, visual, compiled, and/or interpreted programming language.

Unless specifically stated otherwise, it may be appreciated that terms such as "processing," "computing," "calculating," "determining," or the like refer to the action and/or process of a computer or computing system, or similar electronic computing device, that manipulates and/or transforms data represented as physical quantities (for example, electronic) within the registers and/or memory units of the computer system into other data similarly represented as physical quantities within the registers, memory units, or other such information storage transmission or displays of the computer system. The embodiments are not limited in this context.

The terms "circuit" or "circuitry," as used in any embodiment herein, are functional and may comprise, for example, singly or in any combination, hardwired circuitry, programmable circuitry such as computer processors comprising one or more individual instruction processing cores, state machine circuitry, and/or firmware that stores instructions executed by programmable circuitry. The circuitry may include a processor and/or controller configured to execute one or more instructions to perform one or more operations described herein. The instructions may be embodied as, for example, an application, software, firmware, etc. configured to cause the circuitry to perform any of the aforementioned operations. Software may be embodied as a software package, code, instructions, instruction sets and/or data recorded on a computer-readable storage device. Software may be embodied or implemented to include any number of processes, and processes, in turn, may be embodied or implemented to include any number of threads, etc., in a hierarchical fashion. Firmware may be embodied as code, instructions or instruction sets and/or data that are hard-coded (e.g., nonvolatile) in memory devices. The circuitry may, collectively or individually, be embodied as circuitry that forms part of a larger system, for example, an integrated circuit (IC), an application-specific integrated circuit (ASIC), a system-on-a-chip (SoC), desktop computers, laptop computers, tablet computers, servers, smart phones, etc. Other embodiments may be implemented as software executed by a programmable control device. In such cases, the terms "circuit" or "circuitry" are intended to include a combination of software and hardware such as a programmable control device or a processor capable of executing the software. As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

Numerous specific details have been set forth herein to provide a thorough understanding of the embodiments. It will be understood by an ordinarily-skilled artisan, however, that the embodiments may be practiced without these specific details. In other instances, well known operations, components and circuits have not been described in detail so as not to obscure the embodiments. It can be appreciated that the specific structural and functional details disclosed herein may be representative and do not necessarily limit the scope of the embodiments. In addition, although the subject matter has been described in language specific to structural features and/or methodological acts, it is to be understood that the subject matter defined in the appended claims is not necessarily limited to the specific features or acts described herein. Rather, the specific features and acts described herein are disclosed as example forms of implementing the claims.

Further Example Embodiments

The following examples pertain to further embodiments, from which numerous permutations and configurations will be apparent.

Example 1 is a method for updating an audio decoder state. The method comprises: decoding, by an audio decoder, encoded bits included in a sequence of encoded audio packets to generate output audio samples; storing, by the audio decoder, the encoded bits to a decoder history buffer; storing, by the audio decoder, decimated state data associated with the decoding of the stored encoded bits to the decoder history buffer, the state data decimated by a decimation factor associated with a down-sampling output rate of the audio decoder; performing packet loss concealment of an invalid audio packet in the sequence of encoded audio packets, using concealment samples selected from a group of previous output audio samples stored in a packet loss concealment (PLC) history buffer; updating the state of the audio decoder based on state data retrieved from the decoder history buffer, the retrieved state data associated with the decoding of the encoded bits and further associated with a first time equal to or earlier than a second time associated with the concealment samples; re-decoding, by the audio decoder, the stored encoded bits associated with the retrieved state data, the state of the audio decoder further updated during the re-decoding; and decoding, by the audio decoder, a valid audio packet following the invalid audio packet, using the further updated audio decoder state.

Example 2 includes the subject matter of Example 1, wherein the concealment samples are selected by: searching for a first sequence of output audio samples, stored in the PLC history buffer, that satisfy a measure of similarity to output audio samples associated with a valid audio packet immediately preceding the invalid audio packet; and selecting the concealment samples from a second sequence of output audio samples, stored in the PLC history buffer, the second sequence following the first sequence.

Example 3 includes the subject matter of Examples 1 or 2, wherein the re-decoding of the encoded bits associated with the retrieved state data is performed up to a time associated with an end of the second sequence of output audio samples.

Example 4 includes the subject matter of any of Examples 1-3, further comprising discarding results of the re-decoding of the encoded bits associated with the retrieved state data.

Example 5 includes the subject matter of any of Examples 1-4, wherein the sequence of encoded audio packets is received by the audio decoder over a wireless communications link.

Example 6 includes the subject matter of any of Examples 1-5, wherein the wireless communications link conforms to a Bluetooth communications protocol.

Example 7 includes the subject matter of any of Examples 1-6, wherein the audio decoder is a continuously variable slope delta modulation (CVSD) decoder.

Example 8 includes the subject matter of any of Examples 1-7, wherein the state data comprises at least one of a step size, a previous output audio sample, a finite impulse response filter memory, and a sign bit.

Example 9 is a system for updating an audio decoder state. The system comprises: an audio decoder to decode encoded bits included in a sequence of encoded audio packets to generate output audio samples; a decoder history buffer to store the encoded bits and to store decimated state data associated with the decoding of the stored encoded bits, the state data decimated by a decimation factor associated with a down-sampling output rate of the audio decoder; a packet loss concealment (PLC) circuit to perform packet loss concealment of an invalid audio packet in the sequence of encoded audio packets, using concealment samples selected from a group of previous output audio samples stored in a PLC history buffer; a decoder state update circuit to update the state of the audio decoder based on state data retrieved from the decoder history buffer, the retrieved state data associated with a first time equal to or earlier than a second time associated with the concealment samples; the audio decoder further to re-decode the stored encoded bits associated with the retrieved state data, and to further update the state of the audio decoder during the re-decoding; and the audio decoder further to decode a valid audio packet following the invalid audio packet, using the further updated audio decoder state.

Example 10 includes the subject matter of Example 9, wherein the PLC circuit is further to select the concealment samples by: searching for a first sequence of output audio samples, stored in the PLC history buffer, that satisfy a measure of similarity to output audio samples associated with a valid audio packet immediately preceding the invalid audio packet; and selecting the concealment samples from a second sequence of output audio samples, stored in the PLC history buffer, the second sequence following the first sequence.

Example 11 includes the subject matter of Examples 9 or 10, wherein the re-decoding of the stored encoded bits associated with the retrieved state data is performed up to a time associated with an end of the second sequence of output audio samples.

Example 12 includes the subject matter of any of Examples 9-11, wherein the audio decoder is further to discard results of the re-decoding of the stored encoded bits associated with the retrieved state data.

Example 13 includes the subject matter of any of Examples 9-12, wherein the sequence of encoded audio packets is received by the audio decoder over a wireless communications link.

Example 14 includes the subject matter of any of Examples 9-13, wherein the wireless communications link conforms to a Bluetooth communications protocol.

Example 15 includes the subject matter of any of Examples 9-14, wherein the audio decoder is a continuously variable slope delta modulation (CVSD) decoder.

Example 16 includes the subject matter of any of Examples 9-15, wherein the state data comprises at least one of a step size, a previous output audio sample, a finite impulse response filter memory, and a sign bit.

Example 17 is at least one non-transitory computer readable storage medium having instructions encoded thereon that, when executed by one or more processors, cause a process to be carried out for updating an audio decoder state. The process comprises: decoding encoded bits included in a sequence of encoded audio packets to generate output audio samples; storing the encoded bits to a decoder history buffer; storing decimated state data associated with the decoding of the stored encoded bits to the decoder history buffer, the state data decimated by a decimation factor associated with a down-sampling output rate of the decoder; performing packet loss concealment of an invalid audio packet in the sequence of encoded audio packets, using concealment samples selected from a group of previous output audio samples stored in a packet loss concealment (PLC) history buffer; updating the state of the audio decoder based on state data retrieved from the decoder history buffer, the retrieved state data associated with the decoding of the encoded bits and further associated with a first time equal to or earlier than a second time associated with the concealment samples; re-decoding the stored encoded bits associated with the retrieved state data, the state of the audio decoder further updated during the re-decoding; and decoding a valid audio packet following the invalid audio packet, using the further updated audio decoder state.

Example 18 includes the subject matter of Example 17, wherein the concealment samples are selected by: searching for a first sequence of output audio samples, stored in the PLC history buffer, that satisfy a measure of similarity to output audio samples associated with a valid audio packet immediately preceding the invalid audio packet; and selecting the concealment samples from a second sequence of output audio samples, stored in the PLC history buffer, the second sequence following the first sequence.

Example 19 includes the subject matter of Examples 17 or 18, wherein the re-decoding of the encoded bits associated with the retrieved state data is performed up to a time associated with an end of the second sequence of output audio samples.

Example 20 includes the subject matter of any of Examples 17-19, the operations further comprising discarding results of the re-decoding of the encoded bits associated with the retrieved state data.

Example 21 includes the subject matter of any of Examples 17-20, wherein the sequence of encoded audio packets is received by the audio decoder over a wireless communications link.

Example 22 includes the subject matter of any of Examples 17-21, wherein the wireless communications link conforms to a Bluetooth communications protocol.

Example 23 includes the subject matter of any of Examples 17-22, wherein the audio decoder is a continuously variable slope delta modulation (CVSD) decoder.

Example 24 includes the subject matter of any of Examples 17-23, wherein the state data comprises at least one of a step size, a previous output audio sample, a finite impulse response filter memory, and a sign bit.

Example 25 is a system for updating an audio decoder state. The system comprises: decoding, by an audio decoder, encoded bits included in a sequence of encoded audio packets to generate output audio samples; storing, by the audio decoder, the encoded bits to a decoder history buffer; storing, by the audio decoder, decimated state data associated with the decoding of the stored encoded bits to the decoder history buffer, the state data decimated by a decimation factor associated with a down-sampling output rate of the audio decoder; performing packet loss concealment of an invalid audio packet in the sequence of encoded audio packets, using concealment samples selected from a group of previous output audio samples stored in a packet loss concealment (PLC) history buffer; updating the state of the audio decoder based on state data retrieved from the decoder history buffer, the retrieved state data associated with the decoding of the encoded bits and further associated with a first time equal to or earlier than a second time associated with the concealment samples; re-decoding, by the audio decoder, the stored encoded bits associated with the retrieved state data, the state of the audio decoder further updated during the re-decoding; and decoding, by the audio decoder, a valid audio packet following the invalid audio packet, using the further updated audio decoder state.

Example 26 includes the subject matter of Example 25, wherein the concealment samples are selected by: searching for a first sequence of output audio samples, stored in the PLC history buffer, that satisfy a measure of similarity to output audio samples associated with a valid audio packet immediately preceding the invalid audio packet; and selecting the concealment samples from a second sequence of output audio samples, stored in the PLC history buffer, the second sequence following the first sequence.

Example 27 includes the subject matter of Examples 25 or 26, wherein the re-decoding of the encoded bits associated with the retrieved state data is performed up to a time associated with an end of the second sequence of output audio samples.

Example 28 includes the subject matter of any of Examples 25-27, further comprising discarding results of the re-decoding of the encoded bits associated with the retrieved state data.

Example 29 includes the subject matter of any of Examples 25-28, wherein the sequence of encoded audio packets is received by the audio decoder over a wireless communications link.

Example 30 includes the subject matter of any of Examples 25-29, wherein the wireless communications link conforms to a Bluetooth communications protocol.

Example 31 includes the subject matter of any of Examples 25-30, wherein the audio decoder is a continuously variable slope delta modulation (CVSD) decoder.

Example 32 includes the subject matter of any of Examples 25-31, wherein the state data comprises at least one of a step size, a previous output audio sample, a finite impulse response filter memory, and a sign bit.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications. It is intended that the scope of the present disclosure be limited not be this detailed description, but rather by the claims appended hereto. Future filed applications claiming priority to this application may claim the disclosed subject matter in a different manner, and may generally include any set of one or more elements as variously disclosed or otherwise demonstrated herein.

What is claimed is:

1. A method for updating an audio decoder state, the method comprising:

storing, by an audio decoder, decimated state data associated with decoding of stored encoded bits, from a decoder history buffer, the state data decimated by a decimation factor associated with a down-sampling output rate of the audio decoder, the encoded bits included in a sequence of encoded audio packets to generate output audio samples;

updating the state of the audio decoder based on state data retrieved from the decoder history buffer, the retrieved state data associated with the decoding of the encoded bits and further associated with a first time equal to or earlier than a second time associated with concealment samples selected from a group of previous output audio samples; and re-decoding, by the audio decoder, the stored encoded bits associated with the retrieved state data, the state of the audio decoder further updated during the re-decoding.

2. The method of claim 1, further comprising performing packet loss concealment of an audio packet, in the sequence of encoded audio packets, using concealment samples.

3. The method of claim 2, wherein the concealment samples are selected from a group of previous output audio samples stored in a packet loss concealment (PLC) history buffer.

4. The method of claim 2, wherein the packet loss concealment is performed on at least one of a corrupted audio packet and a missing audio packet, in the sequence of encoded audio packets.

5. The method of claim 2, wherein the concealment samples are selected by:

searching for a first sequence of output audio samples, stored in the PLC history buffer, that satisfy a measure of similarity to output audio samples associated with a valid audio packet immediately preceding an invalid audio packet; and selecting the concealment samples from a second sequence of output audio samples, stored in the PLC history buffer, the second sequence following the first sequence.

6. The method of claim 5, wherein the re-decoding of the encoded bits associated with the retrieved state data is performed up to a time associated with an end of the second sequence of output audio samples.

7. The method of claim 1, wherein the sequence of encoded audio packets is received by the audio decoder over a wireless communications link.

8. A system for updating an audio decoder state, the system comprising:

an audio decoder to store decimated state data associated with decoding of stored encoded bits, from a decoder history buffer, the state data decimated by a decimation factor associated with a down-sampling output rate of the audio decoder, the encoded bits included in a sequence of encoded audio packets to generate output audio samples;

a decoder state update circuit to update the state of the audio decoder based on state data retrieved from the decoder history buffer, the retrieved state data associated with a first time equal to or earlier than a second time associated with the concealment samples; and the audio decoder further to re-decode the stored encoded bits associated with the retrieved state data, and to further update the state of the audio decoder during the re-decoding.

9. The system of claim 8, further comprising a packet loss concealment (PLC) circuit to perform packet loss concealment of an audio packet using concealment samples.

10. The system of claim 9, wherein the concealment samples are selected from a group of previous output audio samples stored in a packet loss concealment (PLC) history buffer.

11. The system of claim 9, wherein the packet loss concealment is performed on at least one of a corrupted audio packet and a missing audio packet, in the sequence of encoded audio packets.

12. The system of claim 9, wherein the PLC circuit is further to select the concealment samples by:

searching for a first sequence of output audio samples, stored in the PLC history buffer, that satisfy a measure of similarity to output audio samples associated with a valid audio packet immediately preceding an invalid audio packet; and selecting the concealment samples from a second sequence of output audio samples, stored in the PLC history buffer, the second sequence following the first sequence.

13. The system of claim 12, wherein the re-decoding of the encoded bits associated with the retrieved state data is performed up to a time associated with an end of the second sequence of output audio samples.

14. The system of claim 8, wherein the sequence of encoded audio packets is received by the audio decoder over a wireless communications link.

15. At least one non-transitory computer readable storage medium having instructions encoded thereon that, when executed by one or more processors, cause a process to be carried out for updating an audio decoder state, the process comprising:

storing decimated state data associated with decoding of stored encoded bits, from a decoder history buffer, the state data decimated by a decimation factor associated with a down-sampling output rate of the audio decoder, the encoded bits included in a sequence of encoded audio packets to generate output audio samples;

updating the state of the audio decoder based on state data retrieved from the decoder history buffer, the retrieved state data associated with the decoding of the encoded bits and further associated with a first time equal to or earlier than a second time associated with concealment samples selected from a group of previous output audio samples; and re-decoding the stored encoded bits associated with the retrieved state data, the state of the audio decoder further updated during the re-decoding.

16. The computer readable storage medium of claim 15, further comprising the operation of performing packet loss concealment of an audio packet, in the sequence of encoded audio packets, using concealment samples.

17. The computer readable storage medium of claim 16, wherein the concealment samples are selected from a group of previous output audio samples stored in a packet loss concealment (PLC) history buffer.

18. The computer readable storage medium of claim 16, wherein the packet loss concealment is performed on at least one of a corrupted audio packet and a missing audio packet, in the sequence of encoded audio packets.

19. The computer readable storage medium of claim 16, wherein the concealment samples are selected by:

searching for a first sequence of output audio samples, stored in the PLC history buffer, that satisfy a measure of similarity to output audio samples associated with a valid audio packet immediately preceding an invalid audio packet; and selecting the concealment samples from a second sequence of output audio samples, stored in the PLC history buffer, the second sequence following the first sequence.

20. The computer readable storage medium of claim 19, wherein the re-decoding of the encoded bits associated with the retrieved state data is performed up to a time associated with an end of the second sequence of output audio samples.

* * * * *